US007612335B2

(12) United States Patent
Makarov et al.

(10) Patent No.: US 7,612,335 B2
(45) Date of Patent: Nov. 3, 2009

(54) METHOD AND APPARATUS FOR ION FRAGMENTATION BY ELECTRON CAPTURE

(75) Inventors: Alexander Alekseevich Makarov, Cheshire (GB); Eduard V. Denisov, Bremen (GB); Gerhard Jung, Delmenhorst (DE)

(73) Assignee: Thermo Finnigan LLC, San Jose, CA (US)

( * ) Notice: Subject to any disclaimer, the term of this patent is extended or adjusted under 35 U.S.C. 154(b) by 250 days.

(21) Appl. No.: 10/592,744

(22) PCT Filed: Mar. 29, 2005

(86) PCT No.: PCT/GB2005/001198

§ 371 (c)(1),
(2), (4) Date: Sep. 13, 2006

(87) PCT Pub. No.: WO2005/096342

PCT Pub. Date: Oct. 13, 2005

(65) Prior Publication Data

US 2007/0138386 A1 Jun. 21, 2007

(30) Foreign Application Priority Data

Mar. 30, 2004 (GB) ..... 0407152.8

(51) Int. Cl.
*H01J 49/26* (2006.01)

(52) U.S. Cl. ..... 250/282; 250/281; 250/283; 250/286; 250/288; 250/292

(58) Field of Classification Search ..... 250/281, 250/282, 283, 286, 288, 292
See application file for complete search history.

(56) References Cited

U.S. PATENT DOCUMENTS

| | | | | |
|---|---|---|---|---|
| 5,905,258 | A * | 5/1999 | Clemmer et al. | 250/287 |
| 6,770,871 | B1 * | 8/2004 | Wang et al. | 250/281 |
| 2003/0183760 | A1 * | 10/2003 | Tsybin et al. | 250/292 |
| 2004/0155180 | A1 * | 8/2004 | Zubarev | 250/281 |
| 2004/0245448 | A1 * | 12/2004 | Glish et al. | 250/281 |

FOREIGN PATENT DOCUMENTS

| | | | |
|---|---|---|---|
| WO | WO 02/078048 | A1 | 10/2002 |
| WO | WO 02078048 | A1 * | 10/2002 |
| WO | WO 03/102545 | A2 | 12/2003 |

* cited by examiner

*Primary Examiner*—David A Vanore
*Assistant Examiner*—Michael Maskell
(74) *Attorney, Agent, or Firm*—Charles B. Katz

(57) ABSTRACT

The present invention relates to a method and apparatus for ion fragmentation by electron capture. The present invention provides a method of generating fragment ions by electron capture, comprising; directing ions to be fragmented into a fragmentation chamber of a mass spectrometer into a fragmentation chamber of a mass spectrometer arrangement; trapping at least some of the ions to be fragmented in at least one direction of the fragmentation chamber by using a magnetic field, the ions being trapped within a volume V; generating an electron beam using an electron source located away from the volume V; irradiating the trapped ions in the volume V with the electrons generated by the electron source in the presence of the said magnetic field, so as to cause dissociation; and ejecting the resultant fragment ions from the fragmentation chamber for subsequent analysis at a different location away from the fragmentation chamber.

53 Claims, 2 Drawing Sheets

METHOD AND APPARATUS FOR ION FRAGMENTATION BY ELECTRON CAPTURE

The present invention relates to a method and apparatus for ion fragmentation by electron capture.

Mass spectrometry is a well-known analytical technique in which ions of sample molecules are generated by a number of different techniques, and are then analysed according to their mass to charge (m/z) ratios. There are several ways to do this, including trapping ions (such as in the well-known Paul ion trap, or in a Fourier Transform Ion Cyclotron Resonance (FT-ICR) cell, for example) or by allowing the ions to fly through to a detector, such as in a Time of Flight (TOF) device.

One technique that is particularly useful in analysing larger molecules is tandem mass spectrometry, in which ions of a large sample molecule are broken into smaller, fragment ions for subsequent analysis. This procedure may provide detailed structural information on the original sample molecules.

Various techniques are known for inducing dissociation of the parent ions. The most common of these is collisionally induced dissociation (CID), where gas atoms or molecules such as argon, helium or nitrogen are employed to cause fragmenting through collisions with the sample ions. Other techniques, using infrared photon irradiation, for example, are also known for fragmenting ions. There are a number of problems with such techniques. The occurrence of internal fragmentation may complicate interpretation, and it is usual for the weakest bonds in a parent ion to be cleaved so that the same mass products are yielded in similar abundance.

In recent years, techniques involving dissociation through the use of electrons have been disclosed. One particular dissociation technique involving electrons is known as electron capture dissociation (ECD) and is described in, for example, Zubarev R. A., Kelleher N. L., McLafferty F. W., J. Am. Chem. Soc., 1998, 120: 3265-3266; McLafferty F. W., Fridriksson E. K., Horn D. M., Zubarev R. A., Science, 1999, 284: 1289-1290; and Haselmann K. F., Budnik B. A., Olsen J. V., Nielsen M. L., Reis C. A., Clausen H., Johnson A. H. Zubarev R. A., Anal. Chem. 2001, 73: 2998-3005. Here, low energy electrons are captured by parent ions (at least doubly protonated) resulting in fragmentation of the bonds in that ion to produce fragment ions. Compared to traditional techniques such as CID, for example, ECD has the major benefit that cleavage is of different and often analytically more helpful bonds. For example, in analysis of polypeptides, ECD cleaves the N-$C_\alpha$ backbone bonds, disulfide bonds, and so forth, whereas the traditional CID or laser (photon) dissociation techniques mainly cleave the amide backbone bonds (i.e. the peptide bonds). The two techniques (CID or other similar techniques, and ECD) may be employed together to produce complementary data.

ECD has, to date, largely been limited to FT-ICR because, for successful electron capture, the electrons must be travelling slowly (energies only slightly greater than thermal energies), and must have a relatively long residence time in the vicinity of the ions by which they will be captured. Any increase in electron energy creates a dramatic decrease in the capture cross-section. FT-ICR allows low energy electrons to be injected into a trapped ion cloud because of the very strong magnetic field generated by the superconducting magnet of the FT-ICR; electrons simply drift along the magnetic field lines into the ion cloud. One such prior art arrangement is described in US-A-2003/0104483, in which a filament is employed to radiate electrons into a cell of an FT-ICR mass spectrometer containing ions generated by liquid chromatography (LC). In an alternative arrangement, shown in US-A-2003/183760, a hollow cathode and an infrared laser are employed simultaneously to allow traditional or ECD fragmentation of ions in an FR-ICR cell.

FT-ICR mass spectrometry is, nevertheless, typically the most expensive and bulky of the current commercially available mass spectrometry techniques. Attempts to expand ECD to other forms of mass spectrometry have been relatively limited due to the fundamental requirement for low energy electrons. For example, in US-A-2002/0175280, electrons are injected into a Paul ion trap. Since electrons injected during most of the duty cycle of the RF field in the trap will be accelerated by that field to unacceptably high energies, the electrons are allowed to enter the trap only during a very short period during the RF cycle where the electron source potential is not above the trap potential. At other times, the electrons are unable to climb the potential barrier and do not enter the trap at all. The problems even so are a very limited duty cycle, a poorly defined electron energy (resulting in excessive fragmentation in the trap) and deteriorated analytical performance due to space charge effects in the trap.

WO-A-02/078048 discloses a variety of embodiments for seeking to realize ECD in FT-ICR, in a quadrupole (Paul) ion trap, and in an RF-only linear multipole arrangement (triple quadrupole). In the case of the FT-ICR device in this document, the problems of cost and size outlined above exist. For the Paul trap embodiment, the problems of a reasonable duty cycle and the need to avoid undue acceleration of electrons are present. In the case of the triple quadrupole arrangement, there is a very limited residence time of ions in the multipole arrangement so that very high electron currents are needed if any ECD is to occur. As a result, severe space charge effects occur. The residence time in the multipole of the incident ions is also difficult to control, leading to poor fragmentation control. Moreover, the multipole arrangement means that RF fields will be present. Even small RF fields are capable of destabilising electron beams, especially when there is a severe space charge problem.

The problem of ion residence time is addressed in WO-A-03/102545. This document describes trapping ions in a linear multiple ion guide using RF fields. Electron or positron capture dissociation is carried out in the ion guide structures, either alone or in combination with conventional ion fragmentation methods. This document discloses the use of a magnetic field, but this is to enhance the axial capture of slow electrons/positrons introduced into the ion guide. It is stated that the ions are not affected by the magnetic field. The techniques described in this document still suffer from the problem of the RF fields used to trap the ions causing electron destabilisation. There is also a necessary compromise between the position of the electron generator and the ion transport and trapping optics.

Finally, WO-A-03/103007 shows still a further dedicated ECD chamber for use as a stage of, for example a Q/TOF mass spectrometer. In the ECD chamber of this disclosure, ions are introduced either orthogonally, or opposed to, electrons from an electron generator. The document does not, however, address the question of how electrons or ions might be confined in the ECD chamber. The arrangement of WO-A-03/103007 will accordingly suffer from interaction times which are too low and too poorly controllable to provide an adequate fragmentation.

Against the background set out above, the present invention provides an improved ECD method and apparatus. Ions are trapped in a storage device magnetically, so that no RF fields are allowed (under normal circumstances) within the storage device during fragmentation. Although an RF multipole may be employed, in this case, the RF voltage supply is switched off during fragmentation to maintain electron stability at that time.

Embodiments of the present invention provide for the trapping of ions in a storage device, with (unlike in prior art FT-ICR arrangements) the resultant ECD fragments being passed on to the separate mass analyser once they have been created, rather than being analysed in the storage device. This allows the stringent requirements for uniformity of magnetic field to be reduced significantly, which in turn permits the use of compact permanent magnet or Tesla coils.

Additionally or alternatively, the incident ions are kept away from the source of electrons, unlike in the above-referenced non-FT-ICR prior art where the electron source is typically so close to the ion flight path that significant ion loss and even thermal decomposition is likely.

In accordance with a first aspect of the present invention, therefore, there is provided a method of generating fragment ions by electron capture, comprising: (a) directing ions to be fragmented into a fragmentation chamber of a mass spectrometer arrangement; (b) trapping at least some of the ions to be fragmented in at least one direction of the fragmentation chamber by using a magnetic field, the ions being trapped within a volume V; (c) generating an electron beam using an electron source located away from the volume V; (d) irradiating the trapped ions in the volume V with the electrons generated by the electron source in the presence of the said magnetic field, so as to cause dissociation; and (e) ejecting the resultant fragment ions from the fragmentation chamber for subsequent analysis at a different location away from the fragmentation chamber.

In a further aspect of the present invention, there is provided a mass spectrometer comprising: an ion source for generating ions of molecules to be analysed; a fragmentation chamber downstream of the ion source, the fragmentation chamber comprising an ion entrance aperture for receiving ions from the ion source, an ion exit aperture for ejecting ions from the fragmentation chamber, a magnet, and an electron source arranged to generate electrons for direction into the fragmentation chamber, the fragmentation chamber being arranged to trap ions that have entered through the ion entrance aperture within a volume V, the electrons from the electron source being directed towards the volume V so as to irradiate the trapped ions in the presence of the magnetic field generated by the magnet, in order to cause dissociation; and; a mass analyser, arranged to receive the resultant fragment ions that have been ejected from the ion exit aperture thereof.

Further advantageous features are set out in the dependent claims.

The invention may be put into practice in a number of ways, and some specific embodiments will now be described by way of example only and with reference to the accompanying Figures in which.

Figure 1:
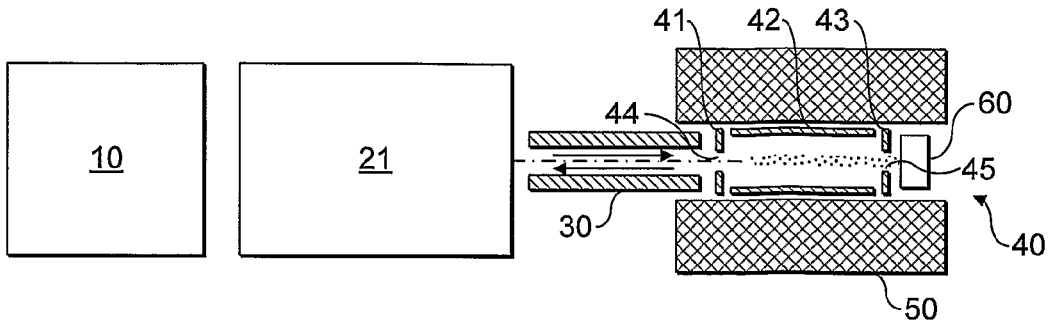
FIG. 1 shows a mass spectrometer in accordance with a first embodiment of the present invention, including an ion fragmentation chamber with an electron source, the chamber being generally on the longitudinal spectrometer axis and employing magnetic trapping of ions.
Figure 4:
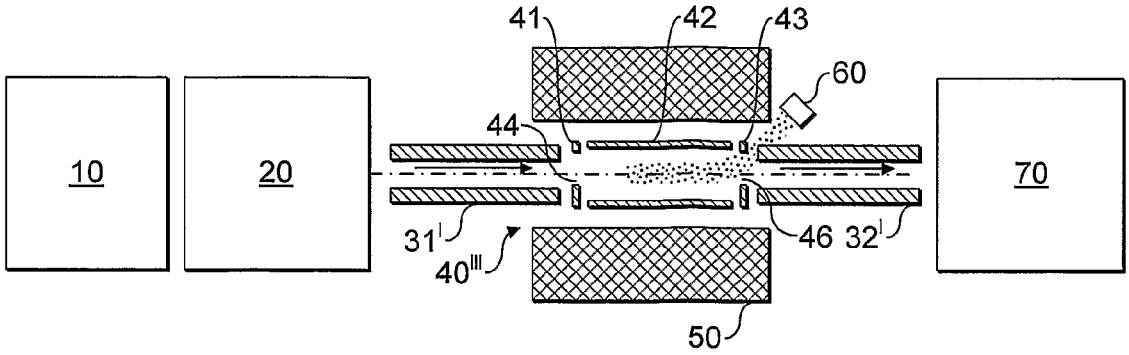
FIG. 4 shows a mass spectrometer in accordance with a fourth embodiment of the present invention including an ion fragmentation chamber that is on the longitudinal axis and which employs magnetic trapping of ions but where the electron source is mounted off axis.
Figure 5:
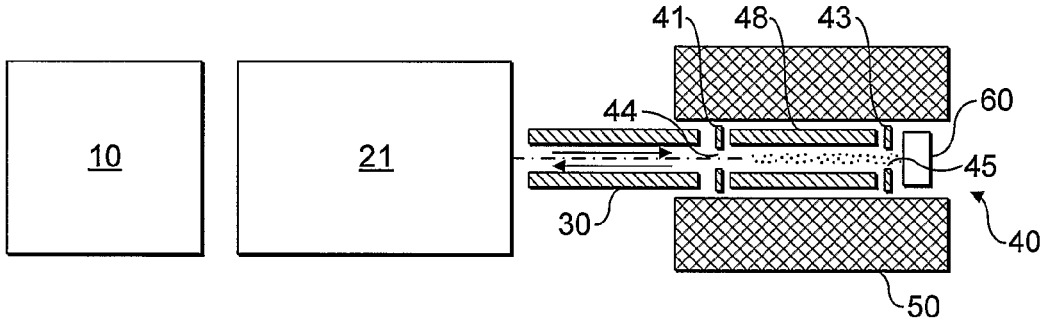
Figure 6:
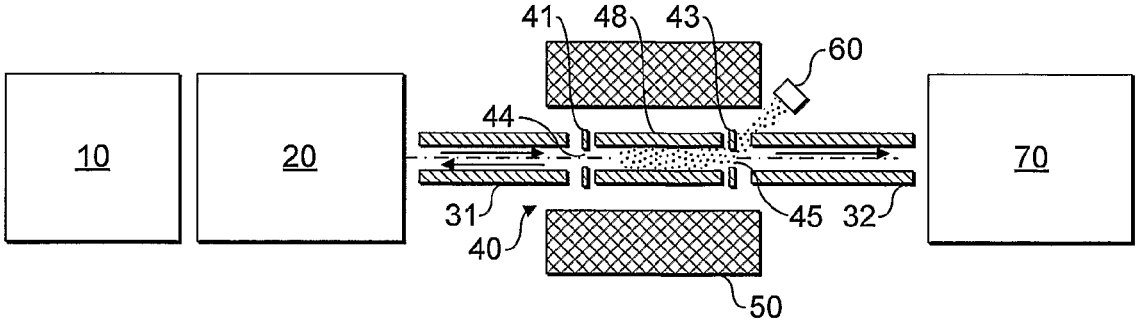

FIG. 5 shows a mass spectrometer in accordance wit a fifth embodiment of the present invention, which is similar to the embodiment of FIG. 1 but which employs an RF ion guide to deliver ions into the ion fragmentation chamber and to assist with trapping of an extended mass range; and FIG. 6 shows a mass spectrometer in accordance with a sixth embodiment of the present invention, which is similar to the embodiment of FIG. 4 but which employs and RF ion guide to deliver ions into the ion fragmentation chamber and to assist with trapping of an extended mass range.

Referring first to FIG. 1, a highly schematic diagram of a mass spectrometer in accordance with a first embodiment of the present invention is shown. The mass spectrometer comprises an ion source 10. The nature of the ion source does not form a part of the present invention and will not be discussed in detail. However, it will be understood that various types of ion source may be employed, such as, but not limited to, gas chromatography (GC), liquid chromatography (LC), atmospheric pressure matrix-assisted laser desorption ionisation (MALDI), collisional MALDI, vacuum MALDI, APCI and APPI and electro-spray ionisation (ESI). Although not shown in FIG. 1, the ion source 10 may also include any transmission or trapping ion optics.

Downstream of the ion source 10 is a linear trap (LT) 21, which, as will be well known, allows mass-selective radial or axial ejection. Ions from the ion source 10 typically contain a range of mass to charge ratios, and ions of only a single mass to charge ratio are passed by the linear trap 21.

Downstream of the linear trap 21 is a fragmentation chamber 40. A transport multipole 30 is located between the linear trap 21 and fragmentation chamber 40. The fragmentation chamber 40 comprises a front plate 41, an opposing back plate 43, and side walls 42. An ion entrance aperture 44 is formed in the front plate 41 of the fragmentation chamber 40, to allow ions from the linear trap 21, via the transport multipole 30 to enter. The fragmentation chamber 40 also includes an electron emitter 60 which, typically, is an indirectly heated cathode or the like which generates a continuous stream of electrons. Formed in the back plate 43 of the fragmentation chamber 40 is an electron entrance aperture 45 which permits electrons emitted by the electron emitter 60 to enter the inside of the fragmentation chamber 40. In the embodiment of FIG. 1, the electron emitter and the electron entrance aperture 45 are generally coaxial with the ion entrance aperture 44.

Surrounding the fragmentation chamber itself is a permanent magnet 50. The axis of the magnetic field along the bore thereof is parallel to the axis of the transport multipole 30 which guides ions from the linear trap 21 into the fragmentation chamber 40, and also parallel to the longitudinal axis of the fragmentation chamber 40 itself.

In use, precursor ions and which are preferably of a single mass to charge ratio isolated in the linear trap 21 and which are preferably injected into the fragmentation chamber 40 as a pulse of length 1-2 ms duration from the linear trap 21, through the transport multipole 30, and through the ion entrance aperture 44 in the front plate 41 of the fragmentation chamber 40. After all ions have passed through the ion entrance aperture 44, the potential of that aperture 44 is raised and ions are trapped in the axial direction of the chamber 40 by a DC voltage on the front and back plates 41, 43. In the embodiment of FIG. 1, ions are trapped radially within the fragmentation chamber 40 by the magnetic field of the permanent magnet 50. Once trapped, ions are irradiated by electrons from the electron emitter 60 passing through the electron entrance aperture 45 in the back plate 43. The electrons have energies preferably in the range 0.1-30 eV.

After an exposure time of about 5-50 ms, electron capture dissociation has taken place and the resulting fragment ions, and any remaining precursor ions, are ejected from the fragmentation chamber 40 back out of the ion entrance aperture 44. As such, the ion entrance aperture 44 is also an ion exit aperture 44. This is done by lowering the voltage on the front plate 41. The electron emitter 60 may remain in continuous operation during this time period.

Upon ejection from the fragmentation chamber 40, fragment ions pass back through the transport multipole 30 to the linear trap 21. Subsequent mass analysis is then carried out in the usual manner.

Various options are contemplated with the arrangement of FIG. 1. For example, ions may be collisionally cooled by admitting collision gas such as nitrogen or helium into the transport multipole 30 or the fragmentation chamber 40. The transport multipole 30 may itself be employed to provide collision-induced dissociation (CID) by applying greater acceleration voltages such as, for example, in excess of 30 eV/kDa.

The use of a linear trap 21 is preferable as opposed to, for example, a 3-D quadrupole (Paul) trap, due to the much higher trapping efficiency of the linear trap (up to 50-90% of incoming ions, compared to a few percent in a quadrupole trap), as well as higher space charge capacity.

It will be understood that the arrangement of FIG. 1 employs no RF trapping. Trapping in the radial direction is achieved primarily by a magnetic field, that is, without such a magnetic field, the ions would be essentially unstable. During fragmentation, RF fields are specifically excluded from the fragmentation chamber 40. This avoids any unwanted acceleration of the electrons (low energy electrons being a prerequisite for ECD). An important additional benefit of using a magnetic field to trap the ions radially is that it significantly reduces the problems of space charge effects which prevent useful operation of a 3-D trap in electron capture dissociation.

Figure 2:
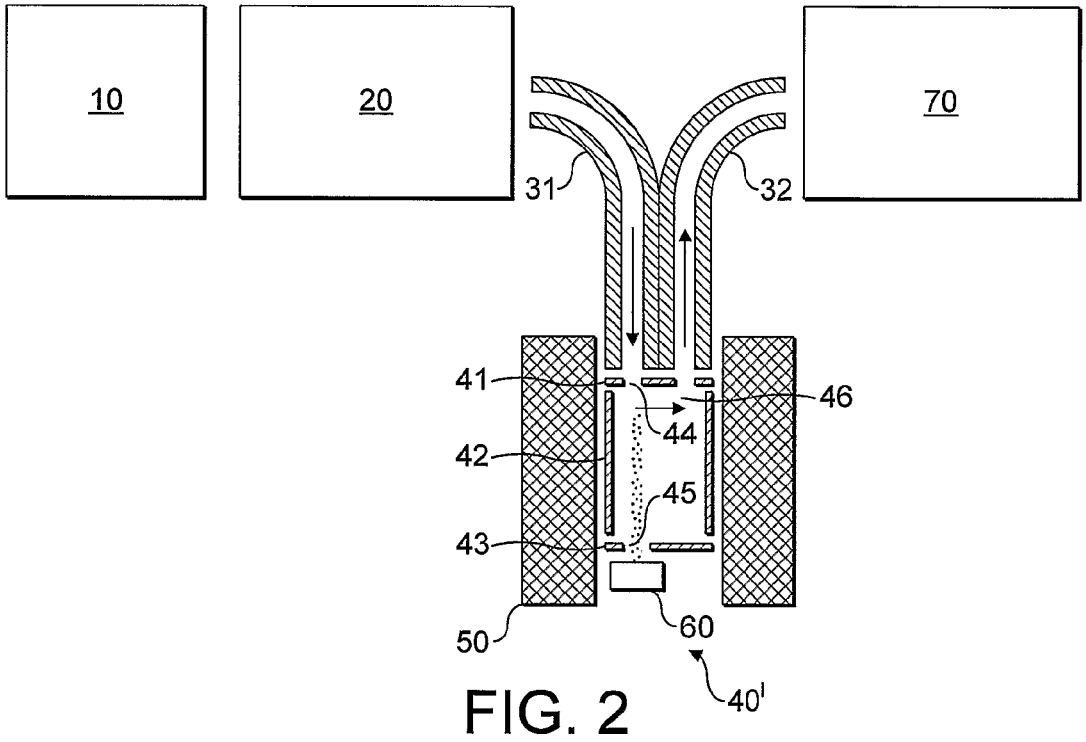
FIG. 2 shows a mass spectrometer in accordance with a second embodiment of the present invention, including an ion fragmentation chamber with an electron source, the chamber lying out of the longitudinal spectrometer axis and employing magnetic trapping of ions.

FIG. 2 shows a mass spectrometer in accordance with a second embodiment of the present invention. Features common to FIGS. 1 and 2 have been labelled with like reference numerals.

In FIG. 1, ions are once again generated by an ion source 10. Ions deriving from the ion source 10 enter a first stage of mass analysis (hereinafter referred to as 'ms-1') 20. For example, this may be again a linear trap or a quadrupole mass filter. This is employed to allow precursor ion selection, that is, selection of preferably a single mass charge ratio of interest. Unlike the linear trap 21 of FIG. 1, the mass filter may be preferably a "fly-through" device that does not trap the ions in it.

Upon exiting ms-1 20, the precursor ions of the selected mass charge ratio enter a curved entrance multipole 31. This contains, in the preferred embodiment, a right-angled bend so that precursor ions exiting ms-1 20 in a first direction leave the curved entrance multipole 31 substantially at 90° to the direction of exit from the mass filter.

Upon exiting the curved entrance multipole 31, ions enter a fragmentation chamber 40'. This is similar to the fragmentation chamber 40 of FIG. 1, in that it contains front and back plates 41, 43, side walls 42, apertures in the front and back plates, permanent magnets 50 surrounding the fragmentation chamber 40' and an electron emitter 60 to the rear of the back plate 43. However, in contrast to the fragmentation chamber 40' of FIG. 1, the front plate 41 has two separate apertures. A first aperture is an ion entrance aperture 44 which is aligned with the exit of the curved entrance multipole 31. A second aperture is spaced, in the front plate 41, from the ion entrance aperture 44 and constitutes an ion exit aperture 46.

The electron entrance aperture 45 formed in the back plate 43 is generally coaxial with the ion entrance aperture 44 formed in the front plate. Thus, ions entering the fragmentation chamber 40' are irradiated by electrons arriving along a broadly similar axis, but in the opposite direction.

Once fragments have been generated (as described in connection with FIG. 1), a voltage is applied to one of the side walls, such as side wall 42, to displace the fragment ions using magnetron motion, off the axis defined between the electron entrance aperture 45 and the ion entrance aperture 44, onto a second axis radially displaced from that first axis in the chamber 40'. This second axis is aligned with the ion exit aperture 46 in the front plate 41 of the fragmentation chamber 40'. Once the fragment ions have been displaced across the fragmentation chamber 40', the voltage on the front plate 41 is reduced to allow the fragment ions to be ejected from the fragmentation chamber 40'.

Aligned with the ion exit aperture 46 is a curved exit multipole 32. The curved exit multipole 32 has, like the curved entrance multipole, a 90° bend in it. Thus, fragment ions exit the fragmentation chamber 40 in a direction parallel with, but in the opposite direction to, the precursor ions arriving at the ion entrance aperture 44. They are then curved round in the curved exit multipole so that they arrive at a second stage of mass analysis (hereinafter referred to as 'ms-2') 70 which is separate from, but has an axis generally parallel with, ms-1 20.

As with the embodiment of FIG. 1, it is possible to use either or both of the curved multipoles 31, 32 for collision-induced dissociation, by applying greater acceleration voltages in excess, for example, of 30 eV/kDa.

Figure 3:
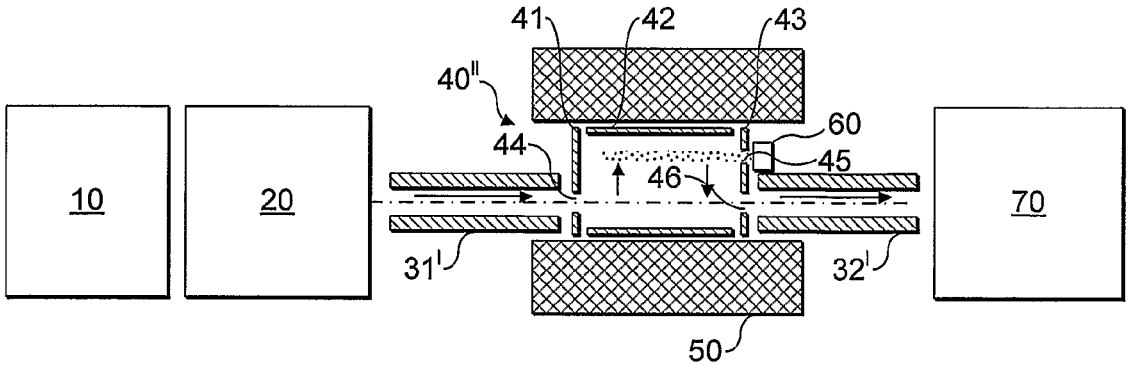
FIG. 3 shows a mass spectrometer in accordance with a third embodiment of the present invention, an ion fragmentation chamber that straddles the longitudinal spectrometer axis and which employs magnetic trapping of ions, but where the electron source is mounted off axis.

FIG. 3 shows a mass spectrometer in accordance with a third embodiment of the present invention. This third embodiment shares a number of analogies with the embodiment of FIG. 2, and, once again, features common to FIGS. 1, 2 and 3 have been labelled with like reference numerals. An ion source 10 generates ions which are received by a first stage of mass analysis (ms-1) 20. Ions of a single mass charge ratio exit ms-1 20 into a first entrance multipole 31', which is, in contrast to the embodiment of FIG. 2, generally straight. In other words, the exit from ms-1 20 is coaxial with the ion entrance aperture 44 in the fragmentation chamber 40".

The ion entrance aperture 44 is formed within a front plate 41 of the fragmentation chamber 40". This ion entrance aperture 44 is in turn coaxial with an ion exit aperture 46 within the back plate 43 of the fragmentation chamber 40". Also formed in the back plate 43 is an electron entrance aperture 45 to allow injection of electrons from an electron emitter 60 outside of the back plate 43. The electron entrance aperture 45 is radially spaced on the back plate 43 from the ion exit aperture 46. Thus, there is a direct line of sight between the exit of ms-1 20, the entrance multipole 31, and the ion entrance and exit apertures 44, 46 within the fragmentation chamber 40" of FIG. 3.

In use, precursor ions enter the fragmentation chamber 40" through the ion entrance aperture 44. As previously, the voltage on the front plate 41 is increased to generate a potential well in the axial direction for axial trapping. Radial trapping is, again as previously, achieved through the application of a magnetic field from permanent magnets 50. Once trapped, the precursor ions in the fragmentation chamber 40" are displaced via magnetron motion off the axis defined between the ion entrance and exit apertures 44, 46, transversely across to a second axis defined perpendicular to the electron entrance aperture 45. Once resident on this second axis, the ions are irradiated by the incident electrons and electron capture dissociation occurs. After a suitable period of time, such as 1-2 ms again, the resultant fragment ions are displaced back onto the first axis defined between the ion entrance and ion exit apertures 44, 46. Once there, the voltage on the back plate 43 may be reduced to allow ejection of the fragment ions out of the ion exit aperture 46.

An exit multipole 32' is preferably aligned with the ion exit aperture 46 so that the fragment ions are guided by the exit multipole 32' from the ion exit aperture 46 to a mass analyser 70 downstream of the fragmentation chamber 40".

A fourth embodiment of the present invention is shown in FIG. 4. An ion source 10 generates ions which pass through a first stage of mass analysis (ms-1) 20, as previously described in the first three embodiments, so that precursor ions of single mass charge ratio exit ms-1 20. These pass through a straight entrance multipole 31' and into a fragmentation chamber 40'".

The fragmentation chamber 40'" comprises front and back plates 41, 43 with ion entrance and ion exit apertures 44, 46 respectively. Both the ion entrance aperture 44 and the ion exit aperture 46 are coaxial with one another and also with the entrance multipole 31' and ms-1 20 . The fragmentation chamber 40'" also comprises an electron emitter 60 and permanent magnets 50.

In the embodiment of FIG. 4, the electron emitter 60 is located downstream (in terms of net ion flow direction) of the ion exit aperture 44 of the fragmentation chamber 40'". The electron emitter 60 is also mounted at an acute angle to an axis defined between the ion entrance and ion exit apertures 44, 46. In use, electrons are emitted from the electron emitter 60 back towards the ion exit aperture. The electrons start off in a direction having a component in the radial direction of the fragmentation chamber 40'", and a component in the axial direction defined between the ion entrance and ion exit apertures 44, 46, but also in an "upstream" direction relative to the net direction of flow of ions through the mass spectrometer of FIG. 4. The magnetic field lines created by the permanent magnet 50 cause the electron beam to curve as it passes through the ion exit aperture 46 back towards the ion entrance aperture 44 so that the electrons have, essentially, no radial component by the time they reach the centre of the fragmentation chamber 40'". In the embodiment of FIG. 4, therefore, no displacement of the ions in the fragmentation chamber 40'" is necessary.

Downstream of the ion exit aperture 46 (which is also an electron entrance aperture, it will be understood) is an exit multipole 32'. In order to avoid scattering of the electron beam 60, the voltage on the exit multipole 32' must be switched off whilst the electrons pass into the fragmentation chamber 40'". Once fragments have been generated, voltages may be applied once more to the exit multipole 32', along with a reduction in the voltage on the back plate 43, to allow the fragment ions to pass out of the fragmentation chamber 40'" into the exit multipole 32' and from there to a mass analyser 70.

FIG. 5 shows a mass spectrometer in accordance with a fifth embodiment of the present invention. The embodiment of FIG. 5 is structurally very similar to the embodiment of FIG. 1, and will not, therefore, be described in detail. The side walls 42, the fragmentation chamber 40 of FIG. 5 instead employ an elongated set of electrodes 48, such as a storage multipole. An RF voltage supply (not shown) supplies an RF voltage to the storage multipole 48 so that ions are trapped, in the radial direction of the fragmentation chamber 40, using an RF, rather than a magnetic, field. During fragmentation, the RF field is essentially switched off for most of the time, so that, on average, electrons do not experience any significant acceleration.

Additional RF fields (especially those produced using hexapole or octapole devices, or using a set of apertures) may assist in the storage of high mass ions, by augmenting at higher radii the magnetic field which has a limited effect on high mass ions. The net result of the RF field is the same as employing a larger permanent magnet. At the same time, low mass fragments are kept near the axis by the magnetic field, so that the low-mass cutoff in RF fields (a known effect) does not result in ion ejection of these low mass ions. Such extension of the mass range both upwards and downwards is particularly important in electron-based dissociation, because fragments formed during such electron dissociation tend to have a lower charge state than their original pre-cursor ion, so that m/z of the fragment may also be much higher than the m/z of the precursor ion.

It is also possible to employ an RF voltage waveform which is pulsed, and where the duty cycle of that waveform is relatively low. For example, a 400 kHz waveform may be employed, with pulses having a 250 ns duration and with a 2000 ns (2 μs) gap between them. The electrons will enter the volume defined between the front and back plates and the storage multipole 48 throughout the cycle of the RF field. Whilst the voltage pulses are present, however, the electrons will not remain on the axis of the storage multipole 48 but will instead be pushed onto the poles themselves. This is why a relatively long period between pulses is desirable, since it is during that period that the electrons will reside amongst the ions on the axis to allow electron capture dissociation.

In the embodiment of FIG. 5, a typical inscribed radius of the storage multipole 48 may be 4 mm. The RF voltage may be 200-300 V, zero to peak.

The final embodiment, shown in FIG. 6, is analogous to the embodiment of FIG. 4 but, as with the embodiment of FIG. 5, employs RF multipoles 48 instead of side walls 42. In the embodiments of both FIG. 5 and FIG. 6, permanent magnets 50 still provide the primary source of ion trapping over the majority of the range of m/z of fragment ions. Only the upper 10-30% of the range has too high a mass to charge ratio for effective magnetic field trapping.

Magnetic trapping alone has certain attractions, not least that, in the absence of any RF fields, the electrons should not be accelerated or dispersed, but should instead follow the magnetic field lines and drift at lower energies into the ion cloud trapped in the fragmentation chamber 40. The maximum m/z that may be trapped depends upon the magnetic field strength of the permanent magnet employed. With modern permanent magnets, a mass range up to about 2000-4000 Daltons may be stored. Obviously, by using superconductive magnets, larger mass ranges could be stored, but this results in a very expensive fragmentation chamber over all.

The use of an assisting RF field does allow much higher mass ranges to be trapped (as explained above) but means that there is the possibility of dispersal and/or acceleration of electrons at certain times.

Whilst a number of specific embodiments have been described, it will be appreciated that these are by way of example only and that various modifications could be contemplated. For example, the fragmentation chamber 40 could be formed from a quadrupole ion trap, a linear multipole ion trap with mass selective axial ejection, a linear multipole ion trap with mass selective radial ejection, an FT-ICR mass spectrometer, an ion tunnel trap comprising a plurality apertures connected to AC power supplies, or other devices.

Further activation methods may be employed to assist with electron fragmentation. For example, a collision or reaction gas may be added to the fragmentation chamber 40. Stored ions may be irradiated by pulsed or continuous laser radiation. The fragmentation chamber 40, or a part thereof, may be heated. As still a further alternative, ions of the opposite polarity to that of the ions of interest may be introduced from an additional ion source or created with the fragmentation chamber 40.

Moreover, whilst the foregoing preferred embodiments have been described in terms of electron capture dissociation (ECD), since the earliest publication in this field, it has been known that electrons may also cause other types of fragmentation. For example, 'hot' electron capture dissociation may occur at higher electron energies, and electron detachment dissociation may occur for negative ions. Accordingly, it is to be understood that the present invention is not limited to ECD, and that any form of dissociation that involves electrons is to be considered to fall within the scope of this invention.

Either ms-1 20, or ms-2 70, could be any of: a quadrupole ion mobility analyser, a quadrupole ion trap, a linear ion trap, a time of flight mass spectrometer, an FT-ICR mass spectrometer, a so-called orbitrap, as described in, for example, WO-A-02/078046, or any combination thereof. Instead of permanent magnets, Tesla coils may be employed. A high current electron emitter may be employed instead of an indirectly heated cathode, or an array of electron-emitting cathodes (including those made as an integrated circuit), or any other electron-emitting device may be contemplated.

The invention claimed is:

1. A method of generating fragment ions by electron capture, comprising:

(a) storing ions to be fragmented in a first ion trapping device and directing the ions into a fragmentation chamber of a mass spectrometer arrangement;

(b) trapping at least some of the ions in at least one direction of the fragmentation chamber by using a magnetic field, the ions being trapped within a volume V;

(c) generating an electron beam using an electron source located away from the volume V;

(d) irradiating the trapped ions in the volume V with the electrons generated by the electron source in the presence of the said magnetic field, so as to cause dissociation; and (e) ejecting the resultant fragment ions from the fragmentation chamber and receiving and trapping the ejected fragment ions in the first ion trapping device for subsequent analysis at a different location away from the fragmentation chamber.

2. The method of claim 1, wherein the magnetic field is supplied by one or more permanent magnets located adjacent the fragmentation chamber.

3. The method of claim 2, wherein the step (b) of trapping the ions in at least one direction using the magnetic field also comprises focussing the electrons into the volume V so as to cause fragmentation, using that magnetic field as well.

4. The method of claim 1, wherein the step (b) of trapping at least some of the ions further comprises applying a radio frequency (RF) field together with the magnetic field so as to assist the trapping of the ions in the at least one direction of the fragmentation chamber.

5. The method of claim 4, wherein the RF field is across the volume V to assist trapping of a part of the range of mass to charge (m/z) ratios of fragmentations.

6. The method of claim 4, wherein the step of applying an RF field comprises applying an RF field having a non-uniform field profile such that the field strength towards the centre of the volume V is lower than the field strength towards the extremities of that volume V.

7. The method of claim 6, wherein the RF-field's non-uniform field profile is such as to have a substantially non-existent component in a linear direction, in radial coordinates.

8. The method of claim 4, wherein the RF field is generated by a pulsed RF waveform, the electrons from the electron source irradiating the trapped ions in the volume V during a part of the RF waveform.

9. The method of claim 8, wherein the electrons only irradiate the trapped ions in the volume V during the said part of the RF waveform.

10. The method of claim 8, wherein, during the said part of the said RF waveform, the amplitude of the voltage applied to each of a plurality of RF-providing electrodes is substantially similar.

11. The method of claim 8, wherein the electrons from the electron source enter the fragmentation chamber substantially continuously.

12. The method of claim 11, wherein the electrons enter the fragmentation chamber substantially continuously but only irradiate the volume V during the said part of the RF waveform.

13. The method of claim 1, wherein the first ion trapping device is a multipole linear trap (LT).

14. The method of claim 1, wherein the ions arriving from the first ion trapping device enter the fragmentation chamber via a common inlet/outlet aperture.

15. The method of claim 14, wherein the common inlet/outlet aperture is formed opposite an electron entrance aperture within the said fragmentation chamber.

16. The method of claim 13, further comprising generating a plurality of ions to be fragmented, at an ion source upstream of the fragmentation chamber.

17. The method of claim 16, wherein the LT is arranged between the ion source and the fragmentation chamber, the method further comprising filtering the ions from the ion source at the LT in accordance with their mass to charge ratio, so as to reduce the range of mass to charge ratios of the ions directed to the fragmentation chamber relative to the range of mass to charge ratios of ions produced by the ion source.

18. The method of claim 12, further comprising directing the ions into an ion entrance aperture of the fragmentation chamber, and ejecting the resultant ECD fragment ions out of a separate ion exit aperture of the fragmentation chamber.

19. The method of claim 18, wherein the ion entrance and ion exit apertures are formed adjacent each other on a common face of the fragmentation chamber.

20. The method of claim 19, wherein the common face of the fragmentation chamber which contains the ion entrance and ion exit apertures is opposed to an electron entrance aperture also formed within the fragmentation chamber.

21. The method of claim 18, further comprising:

generating ions to be fragmented, by an ion source;

mass filtering the ions generated by the ion source in a first stage mass analyser (ms-1), to reduce the range of mass to charge ratios of ions generated by the ion source which are directed to the fragmentation chamber;

diverting the mass filtered ions between ms-1 and the fragmentation chamber, so that the net direction of travel of the ions leaving ms-1 is different to their net direction of travel upon arrival at the fragmentation chamber; and diverting the fragment ions following ejection from the fragmentation chamber so that the net direction of travel of the ions leaving the fragmentation chamber differs from their net direction of travel downstream thereof.

22. The method of claim 21, wherein the fragment ions are directed to a second stage mass analyser (ms-2) following ejection from the fragmentation chamber.

23. The method of claim 22, wherein the net direction of travel of the ions leaving ms-1 is diverted through about 90° by the time of arrival at the fragmentation chamber; and wherein the net direction of travel of the ions leaving the fragmentation chamber is diverted through about 90° by the time of arrival at ms-2.

24. The method of claim 18, wherein the ion entrance and ion exit apertures are formed on opposite sides of the fragmentation chamber.

25. The method of claim 24, wherein there is a direct line of sight between the ion entrance and the ion exit apertures.

26. The method of claim 24, further comprising deflecting the ions directed into the fragmentation chamber out of the line of sight between the entrance exit apertures prior to irradiation with the electrons in the electron beam.

27. The method of claim 26, further comprising deflecting the fragment ions resulting from irradiation by the electrons back towards the ion exit aperture.

28. The method of claim 24, further comprising:

generating ions to be fragmented, by an ion source; and mass filtering the ions generated by the ion source in a first stage mass analyser (ms-1), to reduce the range of mass to charge ratios of ions generated by the ion source which are directed to the fragmentation chamber.

29. The method of claim 24, wherein the fragment ions are directed to a second stage mass analyser (ms-2) following ejection from the fragmentation chamber.

30. The method of claim 24, wherein the electrons are directed though one of the ion exit aperture and the ion entrance aperture of the fragmentation chamber.

31. The method of claim 1, further comprising adding one or more of a collision or reaction gas to the fragmentation chamber to assist fragmentation of the trapped ions.

32. The method of claim 1, further comprising irradiating the trapped ions with pulsed or continuous laser light.

33. The method of claim 1, further comprising heating at least a part of the fragmentation chamber.

34. The method of claim 16, further comprising introducing ions of a polarity opposite to the polarity of ions received from the ion source.

35. A mass spectrometer comprising:

an ion source for generating ions of molecules to be analysed;

a fragmentation chamber downstream of the ion source, the fragmentation chamber comprising an ion entrance aperture for receiving ions from the ion source, an ion exit aperture for ejecting ions from the fragmentation chamber, a magnet, and an electron source arranged to generate electrons for direction into the fragmentation chamber, the fragmentation chamber being arranged to trap ions that have entered through the ion entrance aperture within a volume V, the electrons from the electron source being directed towards the volume V so as to irradiate the trapped ions in the presence of the magnetic field generated by the magnet, in order to cause dissociation; and, a mass analyser, arranged to receive ions generated by the ion source and configured to mass filter the ions prior to ejection to the fragmentation chamber, the mass analyzer being further arranged to receive the fragment ions that have been ejected from the ion exit aperture of the fragmentation chamber.

36. The mass spectrometer of claim 35, further comprising a first stage analyser between the ion source and the fragmentation chamber, for selectively removing ions arriving from the ion source in accordance with their mass to charge ratio, prior to onward transmission of remaining ions in the direction of the fragmentation chamber.

37. The mass spectrometer of claim 35, wherein the mass analyser is a multipolar Linear Trap (LT).

38. The mass spectrometer of claim 35, wherein the ion entrance aperture and the ion exit aperture are coextensive.

39. The mass spectrometer of claim 36, wherein the fragmentation chamber has a first face and a second, opposing face, wherein the ion entrance and the ion exit apertures are each formed in the first face, and wherein the fragmentation chamber further comprises an electron entrance aperture formed in the second, opposing face.

40. The mass spectrometer of claim 39, further comprising a first ion guide arranged to cause a change in the net direction of travel of ions as they pass from ms-1 to the ion entrance aperture of the fragmentation chamber.

41. The mass spectrometer of claim 40, further comprising a second ion guide arranged to cause a change in the net direction of travel of ions as they pass from the ion exit aperture of the fragmentation chamber to the mass analyser.

42. The mass spectrometer of claim 41, wherein the first and second ion guides are curved or bent.

43. The mass spectrometer of claim 42, wherein the first and second ion guides each cause about a 90° change in the net ion flow direction, so that the direction of flow of ions exiting ms-1 is generally parallel with the direction of flow of ions entering the mass analyser.

44. The mass spectrometer of claim 35, wherein the ion entrance aperture and the ion exit aperture are each in a line of sight of each other defining an ion transmission axis, and wherein the electron source is arranged off that ion transmission axis and outside of the fragmentation chamber, electrons from the electron source being bent along the lines of magnetic flux generated by the magnet so as to pass through one of the ion entrance or ion exit apertures and onto the ion transmission axis inside the fragmentation chamber for irradiation of the incident ions trapped in the volume V there.

45. The mass spectrometer of claim 35, wherein the magnet is arranged to trap ions in the fragmentation chamber, in at least one direction thereof, as well as to provide electron focussing.

46. The mass spectrometer of claim 35, the fragmentation chamber further comprising a plurality of elongate electrodes, and an RF voltage generator arranged to generate an RF electromagnetic field which assists in the trapping of ions in the fragmentation chamber, in at least one direction thereof.

47. The mass spectrometer of claim 46, wherein the RF generator is arranged to generate a pulsed RF waveform, the electrons from the electron source irradiating the trapped ions in the volume V during a part of the RE waveform.

48. The mass spectrometer of claim 47, wherein the electrons only irradiate the trapped ions in the volume V during the said part of the RE waveform.

49. The mass spectrometer of claim 48, wherein, during the said part of the said RE waveform, the magnitude of the voltage applied to each of the plurality of elongate electrodes is substantially similar.

50. The mass spectrometer of claim 49, wherein the electrons enter the fragmentation chamber substantially continuously but only irradiate the volume V during the said part of the RE waveform.

51. The mass spectrometer of claim 46, wherein the plurality of elongate electrodes comprises more than four electrodes.

52. The mass spectrometer of claim 46, wherein the plurality of elongate electrodes include a plurality of apertures, each aperture defining an opening which is at least twice the separation between adjacent apertures.

53. A method of generating fragment ions by electron capture, comprising:

(a) directing the ions to be fragmented into a fragmentation chamber of a mass spectrometer arrangement through an ion entrance aperture of the fragmentation chamber;

(b) trapping at least some of the ions to be fragmented in at least one direction of the fragmentation chamber by using a magnetic field, the ions being trapped within a volume V;

(c) generating an electron beam using an electron source located away from the volume V;

(d) irradiating the trapped ions in the volume V with the electrons generated by the electron source in the presence of the said magnetic field, so as to cause dissociation; and (e) ejecting the resultant fragment ions from the fragmentation chamber through an ion exit aperture thereof and receiving and trapping the ejected fragment ions in the first ion trapping device for subsequent analysis at a different location away from the fragmentation chamber, wherein the ion entrance aperture and ion exit aperture are separate and formed adjacent each other on a common face of the fragmentation chamber.

* * * * *